US005236260A

United States Patent [19]

Yu

[11] Patent Number: 5,236,260

[45] Date of Patent: Aug. 17, 1993

[54] SHUTTER WITH JUXTAPOSED SLATS FOR A CABINET

[76] Inventor: Jackson Yu, 2F, No. 2, Chung-Hua St., Peitou Dist., Taipei City, Taiwan

[21] Appl. No.: 904,656

[22] Filed: Jun. 26, 1992

[51] Int. Cl.[5] ..... E06B 9/15

[52] U.S. Cl. ..... 312/297; 160/36

[58] Field of Search ..... 312/297, 294; 160/36, 160/37, 229.1, 232, 235, 214

[56] References Cited

U.S. PATENT DOCUMENTS

| | | | |
|---|---|---|---|
| 462,094 | 10/1891 | Fowler | 160/229.1 |
| 532,021 | 6/1895 | Brown | 312/297 |
| 1,216,731 | 2/1917 | Ratner | 312/297 |
| 3,044,841 | 7/1962 | Hein | 312/297 |
| 3,645,597 | 2/1972 | Sakow | 312/297 |
| 4,618,070 | 10/1986 | Huckle | 312/297 |

FOREIGN PATENT DOCUMENTS

| | | | |
|---|---|---|---|
| 42809 | 12/1981 | European Pat. Off. | 312/297 |
| 1037868 | 9/1953 | France | 160/229.1 |
| 1385298 | 3/1964 | France | 160/232 |

*Primary Examiner*—Peter M. Cuomo
*Assistant Examiner*—Flemming Saether
*Attorney, Agent, or Firm*—Oblon, Spivak, McClelland, Maier & Neustadt

[57] ABSTRACT

A shutter for a cabinet includes a plurality of juxtaposed slats. Each slat has a front side, a back side, a longitudinal upper portion, a longitudinal lower portion, a longitudinal intermediate portion between the longitudinal upper and lower portions, a longitudinal rib projecting from the back side at the intermediate portion, and a pin and eye assembly. The pin and eye assembly includes a pin member provided on the back side at the upper portion and extending in a direction substantially parallel to the rib and an eye member provided on the back side at the lower portion. The pin member of one of the slats engages the eye member of an adjacent one of the slats so as to hinge the one of the slats to the adjacent one of the slats.

2 Claims, 5 Drawing Sheets

SHUTTER WITH JUXTAPOSED SLATS FOR A CABINET

BACKGROUND OF THE INVENTION

1. Field of the Invention

This invention relates to a shutter, more particularly to an improved shutter for a cabinet and the like.

2. Discussion of the Background

Referring to FIG. 1, a cabinet (1) has an entrance (11) and a drawable shutter (2) to close the entrance (11). Referring to FIG. 2, the shutter (2) includes a piece of cloth (22) and a plurality of spaced parallel slats (21) fixed on the cloth (22). The slats (21) can be made of wood or plastic material. Since slats (21) on the cloth (22) are arranged to be spaced from and parallel to one another, it costs much time and labor to manufacture the shutter (2). Since the slats (21) are fixed on the cloth (22) and are not detachable, a new shutter (2) is needed when one of the slats (21) of the old shutter (2) is damaged. Therefore, the shutter (2) does not have a long service life, which is not economical. Furthermore, there are clearances (211) between the slats (21) wherein dust easily accumulates. Due to the presence of the clearances (211), the surface of the shutter (2) is not even, and the effect of the decorative patterns provided thereon is not good.

SUMMARY OF THE INVENTION

Therefore, the objective of this invention is to provide an improved shutter for a cabinet. The improved shutter has detachable slats which are easily manufactured and assembled. The improved shutter has a flat front surface so dust cannot easily accumulate thereon and so the effect of the decorative patterns thereon is good.

Accordingly, a shutter for a cabinet includes a plurality of juxtaposed slats. Each slat has a front side, a back side, a longitudinal upper portion, a longitudinal lower portion, a longitudinal intermediate portion between the longitudinal upper and lower portions, a longitudinal rib projecting from the back side at the intermediate portion, and a pin and eye assembly. The pin and eye assembly includes a pin member provided on the back side at the upper portion and extending in a direction substantially parallel to the rib and an eye member provided on the back side at the lower portion. The pin member of one of the slats engages the eye member of an adjacent one of the slats so as to hinge the one of the slats to the adjacent one of the slats.

BRIEF DESCRIPTION OF THE DRAWING

Other features and advantages of the present invention will become apparent in the following detailed description of the preferred embodiment, with reference to the accompanying drawings, of which.

DESCRIPTION OF THE PREFERRED EMBODIMENT

Figure 1:
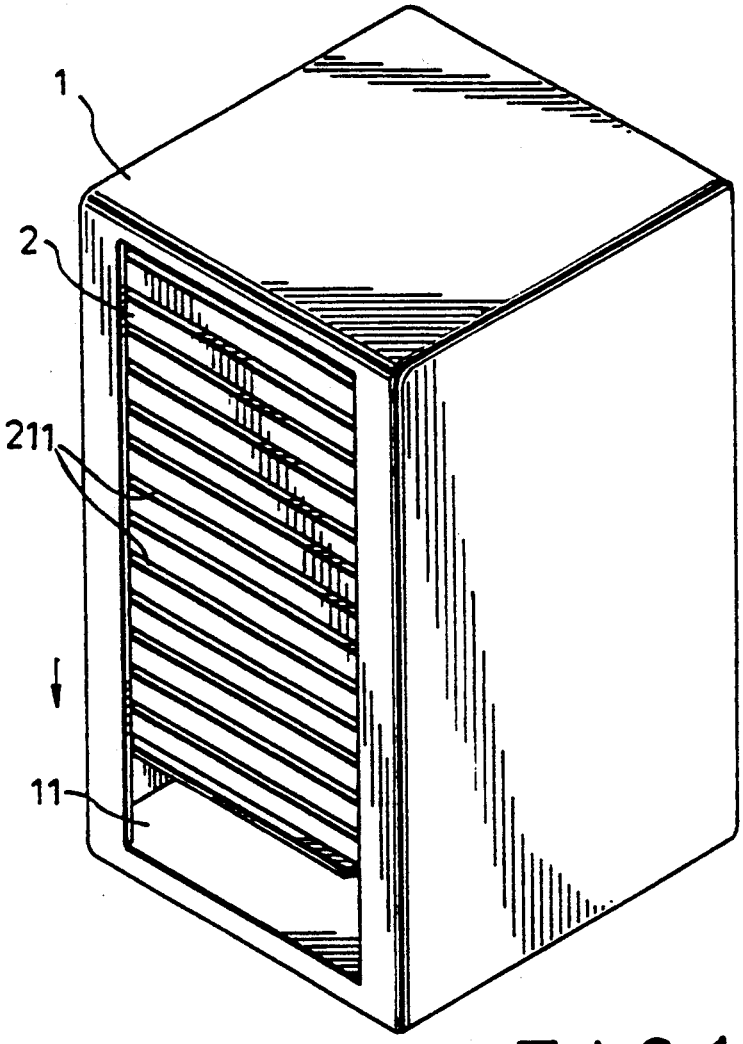
FIG. 1 PRIOR ART
FIG. 1 is a perspective view of a cabinet with a conventional shutter.
Figure 2:
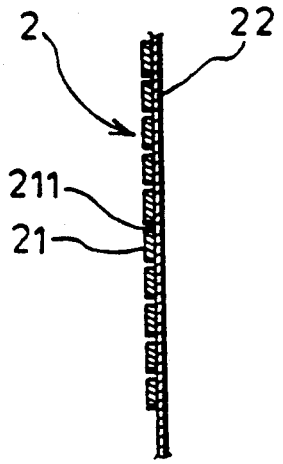
FIG. 2 PRIOR ART
FIG. 2 is a schematic view of the conventional shutter.
Figure 3:
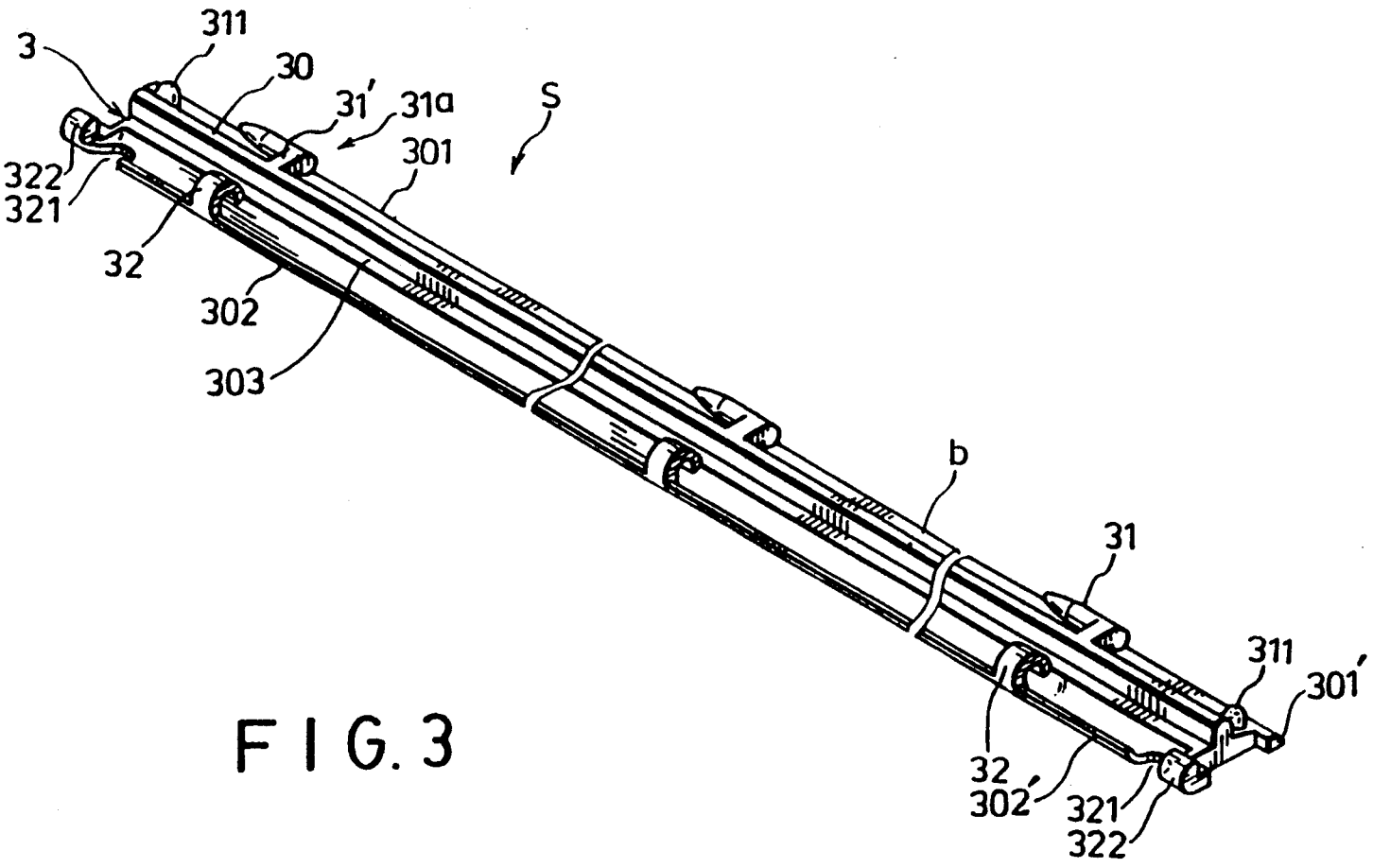
FIG. 3 is a perspective view of the slat of the improved shutter of this invention.

Referring to FIGS. 3 to 6, an improved shutter (S) includes a plurality of juxtaposed slats (3). Each of the slats (3) has a front side (f), a back side (b), a longitudinal upper portion (301), a longitudinal lower portion (302), and a longitudinal intermediate portion (303) between the longitudinal upper and lower portions (301, 302). The longitudinal upper portion (301) has a longitudinal tapered part (301'). The longitudinal lower portion (302) has a peripheral curved part (302'). Each slat (3) further includes a longitudinal rib (30) projecting from the back side (b) at the intermediate portion (303) and three spaced pairs of pin and eye assemblies (31*a*). Each pair of pin and eye assemblies (31*a*) has a pin member (31) provided on the back side (b) at the upper portion (301) and extending in a direction substantially parallel to the rib (30), a branch (31') projecting from the rib (30) to connect the rib (30) and the pin member (31), and an eye member (32) provided on the peripheral curved part (32') of the lower portion (302). The slat (3) has two ends, a rounded protrusion (311) provided on the back side (b) at the upper portion (301) on each of the two ends, a notch (321) formed on the lower portion (302) at the peripheral curved part (302') on each of the two ends, and a substantially semicircular stop block provided on the back side (b) at the lower portion (302) on each of the two ends. The slats (3) can be made of a plastic material by injection-molding.

Figure 4:
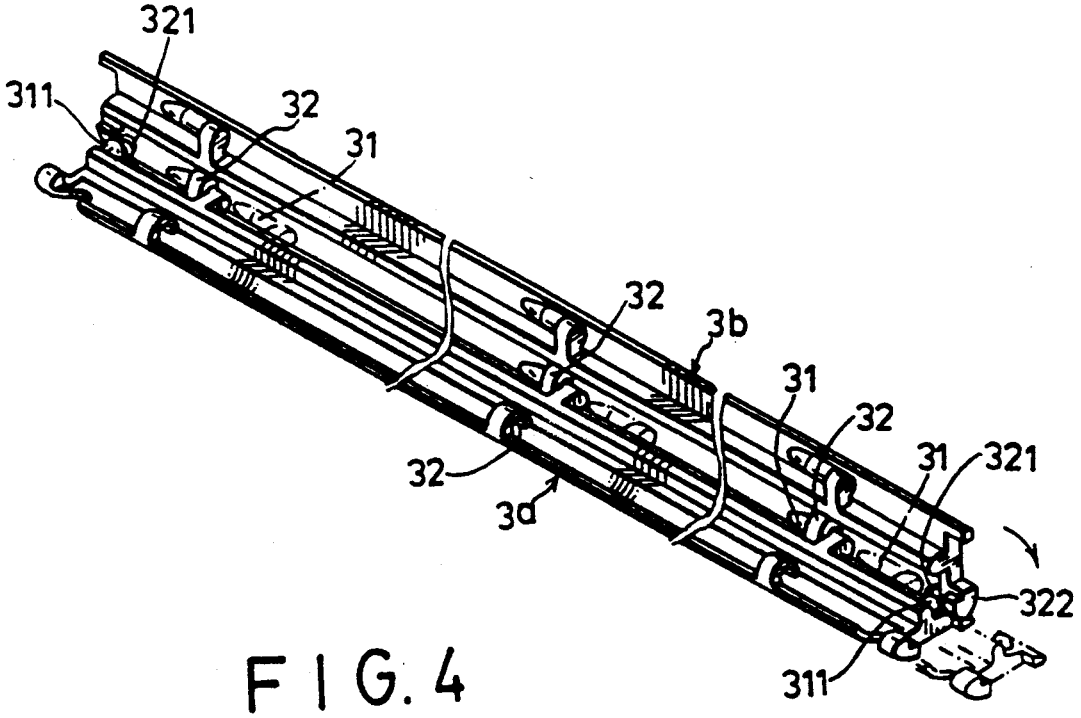
FIG. 4 shows how to assemble the slats of the improved shutter.
Figure 5:
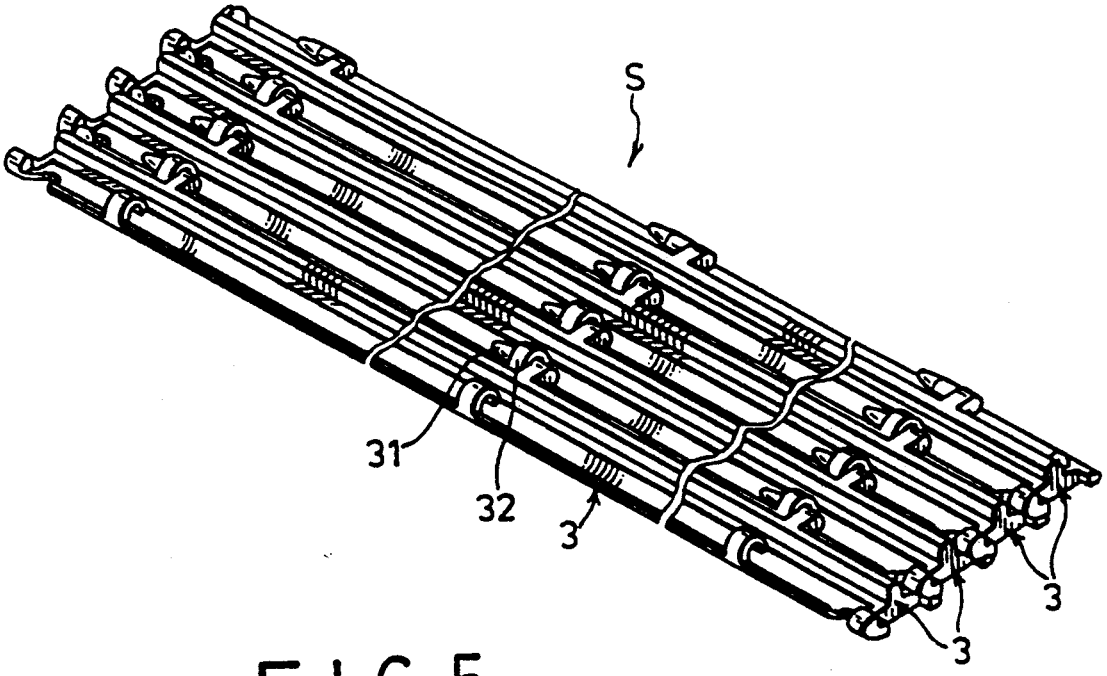
FIG. 5 is a perspective view of the improved shutter.
Figure 6:
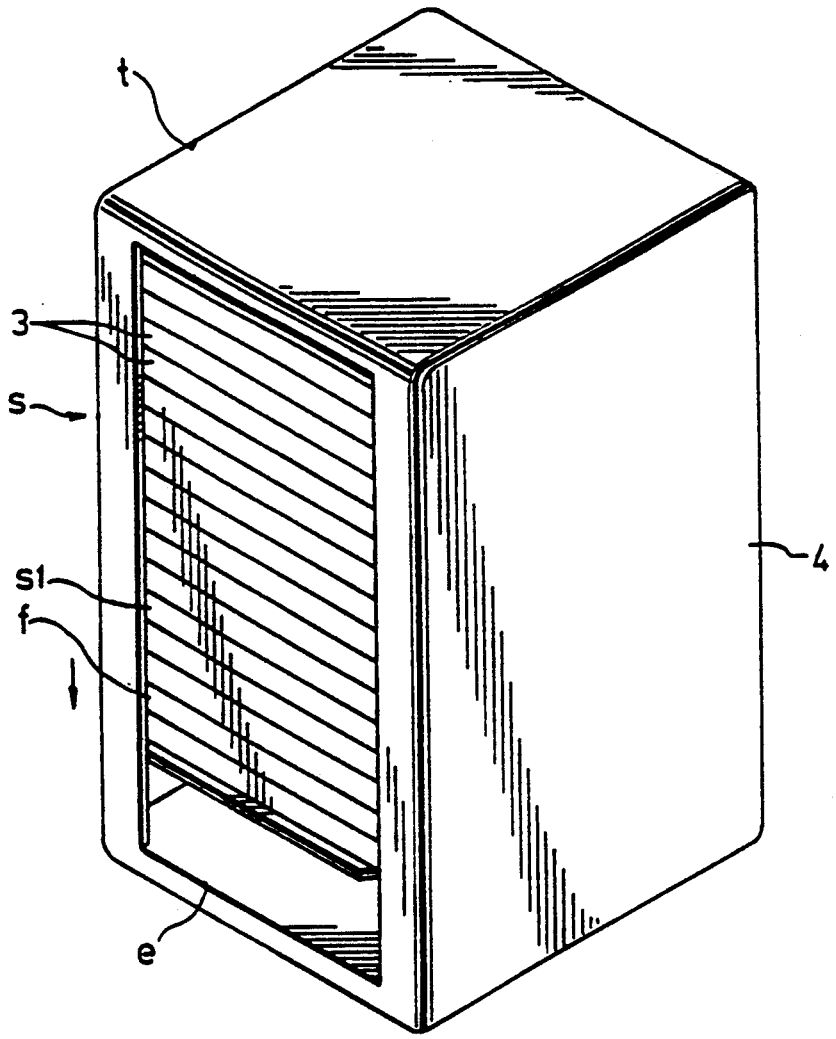
FIG. 6 is a perspective view of a cabinet with the improved shutter.

FIG. 4 shows how to assemble the slats (3) to form the shutter (S). The pin members (31) of a first slat (3*a*) engage the eye members (32) of a second slat (3*b*), which is positioned in a direction substantially perpendicular to the first slat (3*a*), so as to hinge the first slat (3*a*) to the second slat (3*b*). The peripheral curved part (302') of the lower portion (302) of the second slat (3*b*) is superimposed on the tapered part (301') of the upper portion (301) of the first slat (3*a*). The protrusions (311) of the first slat (3*a*) engage in the notches (321) of the second slat (3*b*) respectively. The stop blocks (322) of the second slat (3*b*) are provided to prevent the detachment between the first and second slats (3*a*, 3*b*). Therefore, the second slat (3*b*) can be foldable with respect to the first slat (3*a*). Referring to FIGS. 5 and 6 again, the front sides (f) of the slats (3) can cooperate to define a flat surface (S1). When the shutter (S) is mounted on a cabinet (4), the shutter (S) can close an entrance (e) of the cabinet (4) and can be drawn into a top side (t) of the cabinet (4) to open the entrance (e).

The shutter (S) of this invention formed with detachable slats are more easily manufactured and assembled than the above described conventional shutter. When one of the slats (3) is damaged, the shutter (S) can still be used by the replacement of the damaged slat. The shutter (S) has a flat front surface (S1) so dust cannot easily accumulate thereon and so the effect of the decorative patterns thereon is good.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A shutter for a cabinet, comprising:

a plurality of juxtaposed slats, each of said slats having a front side, a back side, a longitudinal upper portion, a longitudinal lower portion, a longitudinal intermediate portion between said longitudinal upper and lower portions, a longitudinal rib projecting from said back side at said intermediate portion, and a pin and eye assembly which includes a pin member provided on said back side at said upper portion and extending in a direction substantially parallel to said rib and an eye member provided on said back side at said lower portion, said pin member of one of said slats engaging said eye member of an adjacent one of said slats so as to hinge said one of said slats to said adjacent one of said slats;

wherein said upper portion has a longitudinal tapered part, said lower portion having a peripheral curved part, said peripheral curved part of said one of said slats being superimposed on said tapered part of said adjacent one of said slats when said one of said slats engages said adjacent one of said slats so that said front sides of said slats cooperate to define a flat surface; and wherein each of said slats has two ends, a protrusion provided on said back side at said upper portion on at least one of said two ends, and a notch formed on said lower portion at said peripheral curved part on at least one of said two ends to receive said protrusion of said adjacent one of said slats when said one of said slats is hinged to said adjacent one of said slats.

2. A shutter for a cabinet, comprising:

a plurality of juxtaposed slats, each of said slats having a front side, a back side, a longitudinal upper portion, a longitudinal lower portion, a longitudinal intermediate portion between said longitudinal upper and lower portions, a longitudinal rib projecting from said back side at said intermediate portion, and a pin and eye assembly which includes a pin member provided on said back side at said upper portion and extending in a direction substantially parallel to said rib and an eye member provided on said back side at said lower portion, said pin member of one of said slats engaging said eye member of an adjacent one of said slats so as to hinge said one of said slats to said adjacent one of said slats;

wherein said upper portion has a longitudinal tapered part, said lower portion having a peripheral curved part, said peripheral curved part of said one of said slats being superimposed on said tapered part of said adjacent one of said slats when said one of said slats engages said adjacent one of said slats so that said front sides of said slats cooperate to define a flat surface; and wherein each of said slats has two ends, a protrusion provided on said back side at said upper portion on at least one of said two ends, and a notch formed on said lower portion at said peripheral curved part on at least one of said two ends to receive said protrusion of said adjacent one of said slats when said one of said slats is hinged to said adjacent one of said slats;

wherein each of said slats further has a stop block provided on said back side at said lower portion on at least one of said two ends and adjacent to said notch.

* * * * *